United States Patent [19]

Choksi

[11] 3,974,008

[45] Aug. 10, 1976

[54] METHOD OF MAKING A FRANGIBLE CLOSURE SYSTEM FOR MEDICAL LIQUID CONTAINER

[75] Inventor: Pradip V. Choksi, North Hollywood, Calif.

[73] Assignee: American Hospital Supply Corporation, Evanston, Ill.

[22] Filed: Sept. 15, 1975

[21] Appl. No.: 613,244

Related U.S. Application Data

[62] Division of Ser. No. 338,685, March 7, 1975, Pat. No. 3,923,182.

[52] U.S. Cl. ..... 156/69; 53/39; 156/306; 206/807; 215/253; 215/258; 215/DIG. 3; 220/266; 264/94; 264/328

[51] Int. Cl.[2] ..... B65B 7/00

[58] Field of Search ..... 53/39; 156/69, 306; 220/269, 266; 215/1 C, DIG. 3, 250, 253, 252, 258; 264/94, 97–99, 328; 206/807

[56] References Cited

UNITED STATES PATENTS

| | | | |
|---|---|---|---|
| 3,443,711 | 5/1969 | Olson | 215/349 |
| 3,730,372 | 5/1973 | Komendowski | 215/32 |

*Primary Examiner*—Edward G. Whitby
*Attorney, Agent, or Firm*—Larry N. Barger; Robert T. Merrick

[57] ABSTRACT

A thermoplastic cap having an annular skirt with external left-handed screw threads thereon and a lateral external frangible brim at a lower end of this cap. The cap fits over a dispensing outlet of a thermoplastic bottle and the brim is precision fused to the bottle to form a hermetically sealed container for sterile medical liquids. An annular jacking ring with internal left-handed threads screws onto the cap skirt to open the container by fracturing the cap at its laterally extending frangible brim.

7 Claims, 5 Drawing Figures

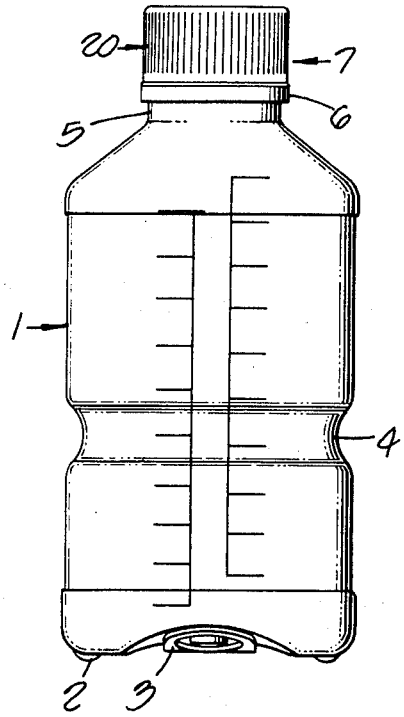
FIG. 1.
FIG. 2.
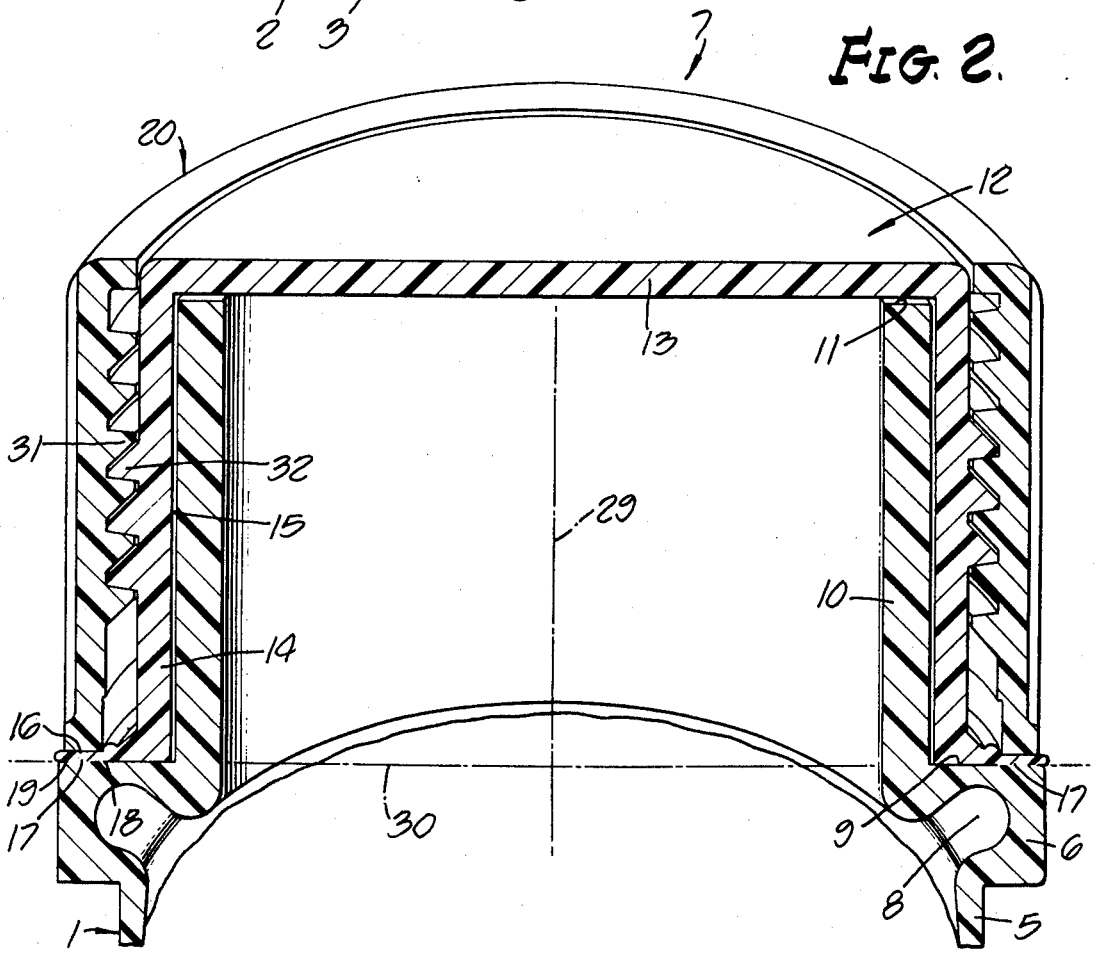

METHOD OF MAKING A FRANGIBLE CLOSURE SYSTEM FOR MEDICAL LIQUID CONTAINER

This is a division of application Ser. No. 338,685, filed Mar. 7, 1975, now U.S. Pat. No. 3,923,182.

BACKGROUND

Sterile medical liquid containers are used to dispense liquids in various medical procedures. One type of container, called a "pouring" container, is used to dispense sterile liquid to a surgical site. Here the physician may pour liquid from the bottle into the surgical wound to cleanse the wound. Another type of medical liquid container is connected to a tube and suspended above the patient to dispense irrigating liquid to a precise site, such as in a transurethral resection procedure. Still another type of medical liquid container is used for the administration of parenteral solution into a patient's vein.

All of these sterile medical liquid containers have a common purpose of maintaining the sterility of their liquid contents during storage, shipping and dispensing. An extremely critical portion of these containers is their closure system. The closure system must maintain a bacteria-tight seal until intentionally opened. All of these closures must be easy for the nurse or physician to open.

One means of providing a bacteria-tight seal in a container closure is to make the closure an integral part of the container. This can be done by forming the container enclosure as a one piece unit such as blow molding, or the closure can be fused or bonded to the container. To open the container a frangible or separable portion of the closure or bottle is broken or torn. Considerable difficulty may be encountered in maintaining the precise control of wall thickness, material formulation, and manufacturing conditions necessary to achieve proper separability. If the frangible section is too thin it increases the chance of a pinhole and contamination. If the frangible section is too thick it is difficult to open. Also with some of these containers the frangible section leaves a ragged pouring or dispensing lip which could shed particles into the sterile liquid.

SUMMARY OF THE INVENTION

This invention provides a new type of frangible medical closure system which is both accurately controllable in the critical frangible area to provide a reliable bacteria-tight seal, and also is easy to open. In this invention the bottle cap is separately formed with a thin injection molded brim integral with a lower portion of the cap. The cap fits over a neck portion of the bottle and the brim overlies an external neck flange of the bottle. In a special heating procedure the brim is permanently fused to this neck flange at an annular band spaced outwardly from the bottle neck. An inner boundary of this annular fusion joint provides an accurately controllable frangible section that is bacteria-tight.

Fitting around the cap is an annular jacking ring. This jacking ring and the side wall of the cap have intermeshing left-handed threads. Counterclockwise rotation of the jacking ring relative to the cap causes the fused band to rupture along an inside boundary of the annular fusion joint. Then the combined jacking ring and cap unit is removed from the bottle neck. The bottle neck then provides a smooth clean dispensing outlet.

THE DRAWINGS

FIG. 1 is a front elevational view of the sterile medical liquid container with closure system;

FIG. 2 is an enlarged perspective view of the closure system and neck portion of the bottle, with a vertical section taken therethrough to expose the internal threaded structure;

DETAILED DESCRIPTION

Figure 3:
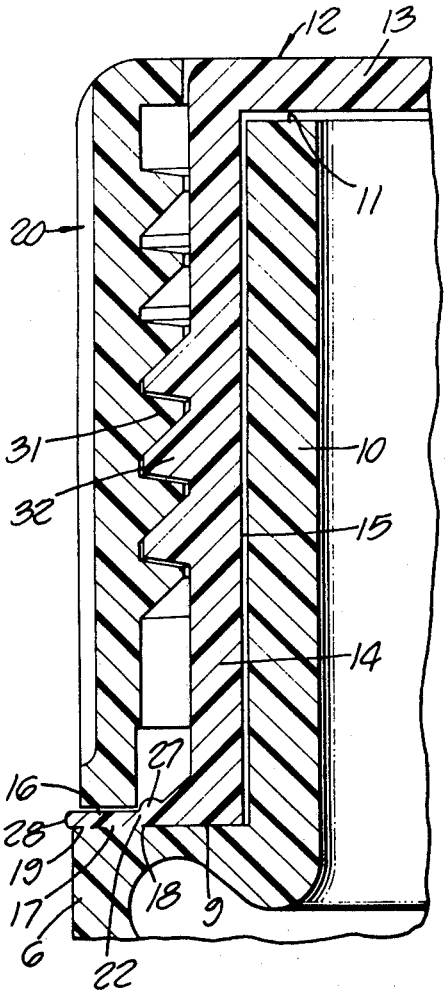
FIG. 3 is a further enlarged sectional view of the closure system as it is shipped and stored.

With reference to these drawings, FIG. 1 shows a blow molded self-supporting thermoplastic bottle 1 having a base portion 2 with a hinged hanger system 3. This hanger system 3 is for supporting the container in an inverted position to dispense liquid. There is also an indented waist section 4 providing an easily grippable middle section of the bottle. At a top of the bottle is a neck portion 5 that includes an external flange 6. A closure system generally indicated at 7 fits over the neck of the bottle.

In the enlarged sectional view of FIG. 2 a more detailed illustration is shown. The bottle in FIG. 2 has a neck flange 6 which has a generally hollow portion 8. This flange 6 has a top portion 9 that proceeds laterally from a dispensing neck 10. At a top of neck 10 is a lip 11.

Fitting over this neck 10 is a cap shown generally at 12. Cap 12 includes a top wall 13 and an annular side wall 14. The side wall 14 has a slight space 15 between the side wall 14 and the neck 10. This space facilitates assembly and removal of the cap from the neck 10. At the lower end of side wall 14 is an annular outwardly extending brim 16 that has a plane 30 perpendicular to a longitudinal axis 29 of neck 10 and cap 12 as shown in FIG. 2. This brim has a thickness of from 0.005 to 0.050 inches (0.127 to 1.27 millimeters). The thickness of the brim will depend on the size of the container and the desired opening force. This brim also must withstand internal pressures created when the bottle is sterilized in an autoclave at 240° to 260° F (116° to 127° C).

A very critical section of the closure system is a bond 17 between the brim 16 and the top surface 9 of flange 6. This bond is a very accurately controlled heat fusion joint that has an inner boundary 18 spaced from the neck 10 and an outer boundary 19. This critical fusion joint will be explained in more detail subsequently.

The cap 12 and its top wall 13, side wall 14 and brim 16 somewhat resembles a hat and combines with the neck portion 5 of the bottle 1 to provide an enclosed hermetically sealed vessel for sterile medical liquids. Because the brim 16 of the cap 12 is injection molded and provides a flat web at a parting line of the mold the dimensions of brim 16 can be very accurately controlled. The brim's thickness dimensions are controlled to ± 0.001 inch (0.025 millimeters). Because the brim lies in a relatively flat lateral plane it is much easier to control the thickness during molding than if the cap had an annular groove around the side wall.

The easy opening feature of the closure system is provided by a jacking ring 20. This jacking ring 20 has an exterior surface that is knurled or grooved for easy gripping. Its internal surface has a left-handed thread structure 31. This thread structure intermeshes with a left-handed thread structure 32 on an outer surface of the side wall of cap 12. Thus, when the jacking ring 20 is rotated in a counterclockwise direction the threads will engage the jacking ring 20 and move downwardly in FIG. 2 rather than upwardly.

FIG. 3 shows a further enlarged sectional view of the jacking ring 20, cap side wall 14 and brim portion 16. In FIG. 3 the jacking ring has its bottom edge spaced slightly from brim 16. This is so that during shipment and storage the jacking ring 20 does not exert a force on rupturable brim 16.

When opening the closure system the jacking ring 20 is rotated counterclockwise to move jacking ring 20 downwardly relative to side wall 14. The lower portion of the jacking ring 20 contacts the bonded portion of brim 16. There is a weakened section of the brim 16 at the inner border 22 of the annular fusion joint between the brim 16 and top surface 9 of flange 6. Thus, as the jacking ring continues in its counterclockwise rotation the side wall 14 and integral brim portion is pulled away from the flange 6. A sharp inner boundary of the jacking ring's annular bottom surface, formed by the right angular intersection of the bottom surface and inside surface of the jacking ring, contacts the brim adjacent its weakened section. This causes a clean break at the inner border of the annular heat joint. The frictional engagement of the threads of the jacking ring and the cap is sufficient to keep the jacking ring from further screwing downwardly on the cap after the break. However, if desired, additional frictional stop structures can be used such as: (1) having a top portion of the jacking ring above the threads wedge against the cap at break; (2) having the fractured edge 22 of the brim wedge against the jacking ring after break; or (3) have the jacking ring threads terminate near the upper end of the cap threads when the break occurs, so the jacking ring cannot screw further down on the cap.

When the break occurs (see FIG. 4) the combined jacking nut 20 and cap 12 can be readily lifted from the neck 10. The neck 10 is now ready for dispensing or pouring the sterile liquid. The upper lip 11 of neck 10 is unaffected by the rupture at brim 16. This is an advantage over some of the previous rupturing type closures which left a ragged edge such as at 22 in the critical pouring lip area.

Figure 4:
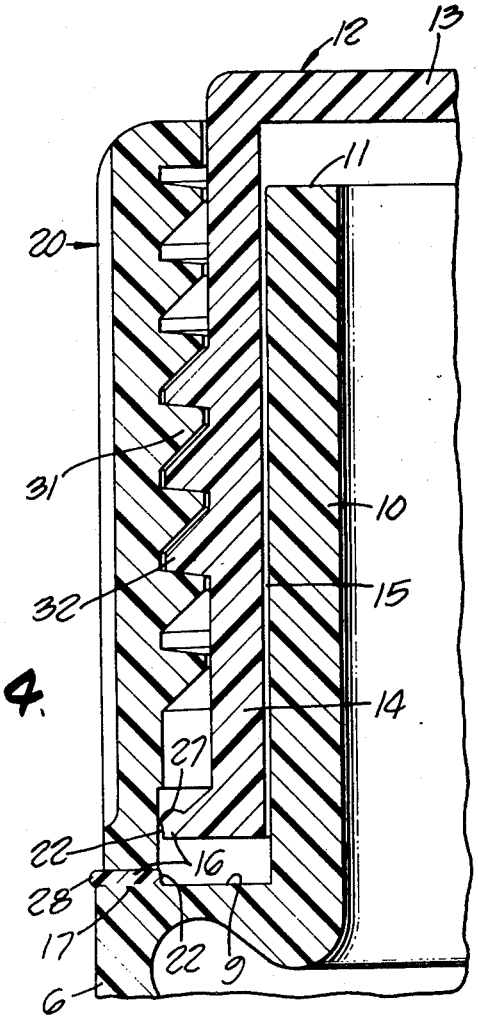
FIG. 4 is an enlarged section view showing the closure system immediately after the cap's frangible brim has been ruptured.

In FIG. 4 after the brim 16 has been ruptured there is a visual indication that the container has been opened. Thus even if the jacking ring 20 is removed from the cap 12 and the cap 12 replaced over neck 10 the rupture line at 22 would be readily visible.

Figure 5:
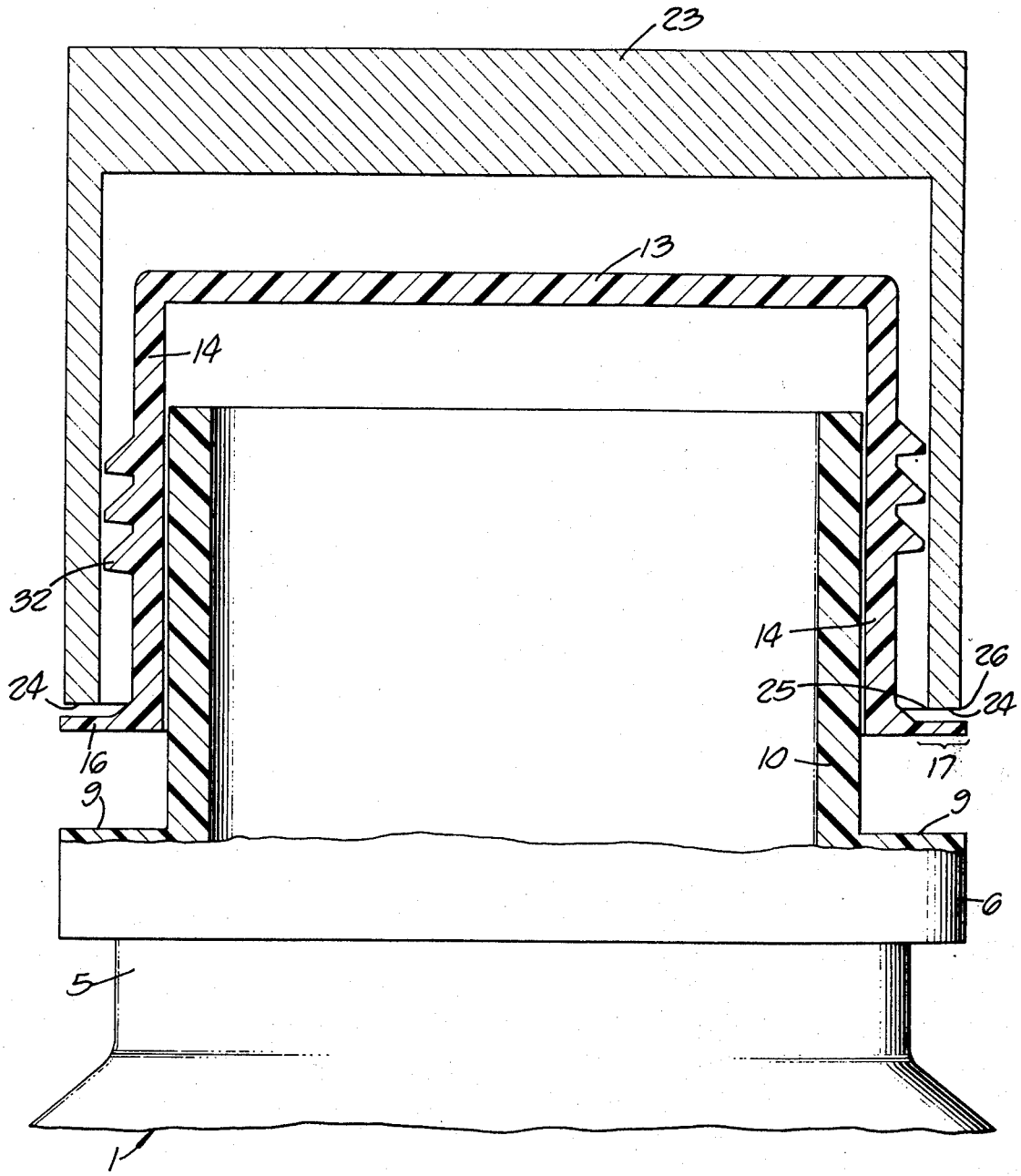
FIG. 5 is a section view showing the method of forming the fusion joint at the frangible brim of the cap.

To provide a reliable rupture joint at 22 a special method is used in forming the bottle and cap combination. This method is illustrated in FIG. 5. In the procedure shown a self-supporting bottle 1 is blow molded with an external annular hollow flange 6. This flange has an accurately controlled top surface 9 that lies along plane 30 that is perpendicular to the longitudinal axis 29 through the bottle neck. This top surface 9 is where the fusion joint takes place.

Next a one piece hat shaped cap is formed with a top wall 13, side wall 14 and brim 16. The left-handed threads 32 are an integral part of the cap. This cap is preferably formed by injection molding with a parting line of the mold at brim 16. This is to very accurately control the thickness and rupturing characteristics of brim 16.

Next the cap 12 is telescopically fitted over neck 10 and brim 16 engages surface 9. Then an annular heating die 23 is lowered into position to contact brim 16. It is noted that the heating die has a welding surface 24 with an inner edge 25 and an outer edge 26. The inner edge 25 of welding surface 24 is spaced a distance from the side wall 14. This is to provide an unsealed portion of the brim 16. The die 23 applies both heat and pressure to an annular bond zone 17. This permanently fuses the skirt and flange 6 into a generally homogeneous thermoplastic bond that appears as an annular band 0.010 to 0.100 inch (0.25 to 2.5 millimeters) wide. As best seen in FIG. 3, the brim 16 is thinned during the bonding process. This causes a small rib to form at 27. There is also a small rib that is normally formed at 28. Both ribs 27 and 28 are formed by displaced molten plastic material from the brim 16 that subsequently cools and solidifies. After the die 13 has sealed brim 16 to flange 6 it is removed. The threaded jacking ring is then screwed onto cap 12. This jacking ring is not screwed tightly down against brim 16 but is spaced slightly therefrom as shown in FIG. 3. This prevents the jacking ring from exerting any rupturing force on brim 16 before it is desired to open the container.

It has been found that the bottle 1 and cap 13 work extremely well in the rupturing brim and bonding areas if they are both made of a polyolefin such as a polyallomer (propylene-ethylene copolymer) thermoplastic material. One such material is marketed by Eastman Chemical Company under the name of Tenite. The jacking ring is preferably of a relatively rigid material such as SAN (styrene-acrylonitrile), acetal, or ABS (acrylonitrile-butadiene-styrene). It is important that a very rigid tough material be used for the jacking ring to keep it from breaking or distorting during assembly and use. However, it is believed apparent that any of a variety of plastic materials having similar properties may be used for the various parts of this invention.

In the foregoing description a specific example has been used to describe the invention. However, it is understood by those skilled in the art that certain modifications can be made to this embodiment without departing from the spirit and scope of the invention.

I claim:

1. A method of forming a sterile medical liquid container comprising the steps of: forming a container with a dispensing neck having a longitudinal axis and a flange with an upper surface that is generally perpendicular to the neck's longitudinal axis; forming a cap with a longitudinal axis, said cap having external threads thereon and an external lateral annular brim lying in a plane generally perpendicular to the cap's longitudinal axis; fitting said cap over said dispensing neck until the frangible brim contacts the container flange; applying an annular heating member to the frangible brim to hermetically fuse at least an annular portion of the frangible brim to the flange; removing said heating member.

2. The method as set forth in claim 1 wherein the steps include forming an internally threaded jacking ring; and screwing said jacking ring onto the cap's external threads.

3. The method as set forth in claim 1, wherein the heating member is brought into contact with only an outer annular portion of the frangible brim, said outer portion being spaced from the cap's skirt.

4. The method as set forth in claim 3 wherein the annular heating member displaces a portion of thermoplastic material to create a weakened fracturable line along an inner boundary of the heat fused joint.

5. The method as set forth in claim 4 wherein the heating member causes a molten annular rib of thermoplastic to form adjacent the weakened fracturable boundary, said annular bead subsequently cooling and solidifying.

6. A method of forming a sterile medical liquid container comprising the steps of:

a. blow molding a thermoplastic container with a dispensing neck having a longitudinal axis;

b. injection molding a thermoplastic cap with a longitudinal axis, external threads, and a frangible section;

c. forming an internally threaded jacking ring;

d. fitting the cap over the container neck without a threaded engagement between the cap and neck;

e. fusing the cap to the bottle; and f. threading the jacking ring unto the external threads of the cap to a depth sufficient to retain the jacking ring on the cap, but stopping short of fracturing the cap's frangible section.

7. The method as set forth in claim 6, wherein the cap and container neck have a common longitudinal axis, and the fusion step includes moving an annular heating die in a direction generally parallel to this common longitudinal axis to fuse the cap to the container.

* * * * *

UNITED STATES PATENT OFFICE
CERTIFICATE OF CORRECTION

PATENT NO. : 3,974,008

DATED : August 10, 1976

INVENTOR(S) : Pradip V. Choksi

It is certified that error appears in the above-identified patent and that said Letters Patent are hereby corrected as shown below:

Patent heading item [62] change "March 7, 1975" to --March 7, 1973--.

Column 1, line 4 change "Mar. 7, 1975" to --Mar. 7, 1973--.

Signed and Sealed this

Twelfth Day of October 1976

[SEAL]

*Attest:*

RUTH C. MASON
*Attesting Officer*

C. MARSHALL DANN
*Commissioner of Patents and Trademarks*